US009637201B2

(12) United States Patent
Hoge, Jr.

(10) Patent No.: US 9,637,201 B2
(45) **Date of Patent: *May 2, 2017**

(54) DROP STITCH INFLATABLE BOAT

(71) Applicant: SEA EAGLE BOATS, INC., Port Jefferson, NY (US)

(72) Inventor: Cecil C. Hoge, Jr., Setauket, NY (US)

(73) Assignee: SEA EAGLE BOATS, INC., Port Jefferson, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/273,062

(22) Filed: Sep. 22, 2016

(65) Prior Publication Data

US 2017/0008602 A1 Jan. 12, 2017

Related U.S. Application Data

(63) Continuation-in-part of application No. 14/505,749, filed on Oct. 3, 2014, now Pat. No. 9,452,809.

(51) Int. Cl.
*B63B 35/71* (2006.01)
*B63B 7/08* (2006.01)

(52) U.S. Cl.
CPC ..... *B63B 7/082* (2013.01); *B63B 7/08* (2013.01); *B63B 35/71* (2013.01); *B63B 2221/18* (2013.01)

(58) Field of Classification Search
CPC ..... B63B 7/08; B63B 35/7913
See application file for complete search history.

(56) References Cited

U.S. PATENT DOCUMENTS 2,873,459 A 2/1959 Marz
3,931,655 A * 1/1976 Luscombe ..... B63B 7/082 114/345
4,489,668 A * 12/1984 Cronin ..... B63B 3/18 114/347
4,942,839 A * 7/1990 Chuan ..... B63B 43/06 114/125
5,282,436 A * 2/1994 Hansen ..... B63B 1/18 114/283
6,022,249 A * 2/2000 Ketterman ..... B63H 1/36 400/21
8,082,871 B2 * 12/2011 Czarnowski ..... B63B 7/08 114/345
8,800,466 B1 8/2014 Shimozono
8,834,220 B2 9/2014 Haller
9,452,809 B2 * 9/2016 Hoge, Jr. ..... B63B 7/08
2011/0303139 A1 12/2011 Hoge, Jr.

OTHER PUBLICATIONS

Office Action dated May 9, 2016 from U.S. Appl. No. 14/505,749.
Notice of Allowance dated Aug. 15, 2016 from U.S. Appl. No. 14/505,749.
U.S. Appl. No. 14/505,749, filed Oct. 3, 2014, Cecil C. Hoge, Jr., Sea Eagle Boats, Inc.

* cited by examiner

*Primary Examiner* — Edwin Swinehart

(57) ABSTRACT

An inflatable dinghy includes a drop stitch inflatable floor made of high pressure drop stitch material; port and starboard drop stitch inflatable sides made of high-pressure drop stitch material attached at outside edges of the drop stitch inflatable floor, respectively; a rigid bow mold attached to the drop stitch inflatable floor and drop stitch inflatable sides; and a rigid stern transom attached to the drop stitch inflatable floor and drop stitch inflatable sides. The inflatable dinghy includes only three separate air compartments including the drop stitch inflatable floor and the drop stitch inflatable sides.

19 Claims, 6 Drawing Sheets

DROP STITCH INFLATABLE BOAT

CROSS-REFERENCE TO RELATED APPLICATIONS

This is a continuation-in-part of prior U.S. application Ser. No. 14/505,749, filed on Oct. 3, 2014, to which the benefit is claimed under 35 U.S.C. §120 and the disclosure of which is incorporated herein by reference.

BACKGROUND

1. Field

Embodiments relate to watercraft, and more particularly, to inflatable boats having drop stitch construction.

2. Description of the Related Art

A kayak is a small watercraft having a narrow beam which typically is propelled by a user's manipulation of a double-bladed paddle. Traditional kayaks were first developed for hunting in inland lakes, rivers and coastal waters, and originally consisted of animal skins stretched over a wood or whalebone frame.

Modern kayaks have long been a popular form of watercraft due their shallow draught, low free board and easy maneuverability. More recently, the popularity of kayaking has increased due to the portability of a kayak, the ability for a user to paddle longer distances than in other self-propelled watercraft such as rowboats and canoes, and the exercise benefits of kayaking that simultaneously allows a user to enjoy their surroundings.

As kayaks entered the modern era, they were constructed of wood or fabric stretched over a wooden frame. More recently, fiberglass kayaks or kayaks constructed of roto-molded polethylene resins are the dominate types of kayak.

Inflatable coated fabric kayaks are also conventionally used. Inflatable coated fabric kayaks have the advantage in that they are easier to store and transport. An inflatable coated fabric kayak typically includes inflatable tubes joined to form the kayak. In particular single round inflatable tubes form both the port and starboard sides of the conventional inflatable coated fabric kayaks, which reduces the speed and maneuverability of the inflatable coated fabric kayaks since with the shape of a round inflatable tube prevents the hull of the inflatable coated fabric kayaks from having a V-shaped hull, and also decreases the speed of the inflatable coated fabric kayaks.

Accordingly, an inflatable kayak, and also other types of boats such as a dinghy and skiff, having the advantages of rigid kayaks, dinghies and skiffs are needed, while still retaining the advantages of economy and portability of their inflatable counterparts.

SUMMARY

Therefore, it is one aspect of the present invention to provide an inflatable kayak having flat sides constructed of drop stitch material to create an inflatable kayak having a V-shaped sides that flare out from the floor. This improves speed and ease of paddling.

Additional aspects will be set forth in part in the description which follows and, in part, will be apparent from the description, or may be learned by practice of the invention.

According to an aspect, an inflatable kayak includes an inflatable floor made of high pressure drop stitch material; and inflatable sides made of high-pressure drop stitch material formed at port and starboard sides of the inflatable floor, respectively.

The inflatable sides may be glued or welded directly to the port and starboard sides of the inflatable floor, and the inflatable sides are configured to be inclined outboard from the inflatable floor. Alternatively, the inflatable sides may be glued or welded to a non-inflated fabric floor and the inflatable floor made of high pressure drop stitch material may be positioned and attached to a top of the non-inflated fabric floor with the inflatable sides pressing against the inflatable floor made of high pressure drop stitch material.

The inflatable kayak may further include a rigid bow mold attached to the inflatable floor and inflatable sides.

The inflatable kayak may further include a rigid stern mold attached to the inflatable floor and inflatable sides.

In the inflatable kayak, the high pressure drop stitch material of the inflatable floor and inflatable sides may include a coated polyester fabric of approximately 1000 denier with 1000 denier drop stitch threads.

In the inflatable kayak, the inflatable floor and inflatable sides may be configured to be inflated to between 3-25 psi.

The inflatable kayak may have a length of between 9-21 feet.

The inflatable kayak may have a beam of between 22-32 inches.

In the inflatable kayak, a thickness of the drop stitch material used for the inflatable floor and the inflatable sides may be between 3-8 inches.

The inflatable may have an asymmetrical shape in a fore and aft direction, the inflatable kayak being slightly wider aft of an amidships portion and slightly narrower forward of the amidships portion.

The inflatable kayak may include one or more skegs formed on an after portion of a bottom of the inflatable floor, to improve tracking while paddling.

In the inflatable kayak, the rigid bow mold and the rigid stern mold may be made of rigid engineering or composite plastic.

According to another aspect an inflatable dinghy includes a drop stitch inflatable floor made of high pressure drop stitch material; port and starboard drop stitch inflatable sides made of high-pressure drop stitch material attached at outside edges of the drop stitch inflatable floor, respectively; a rigid bow mold attached to the drop stitch inflatable floor and drop stitch inflatable sides; a rigid stern transom attached to the drop stitch inflatable floor and drop stitch inflatable sides, where the inflatable dinghy includes only three separate air compartments including the drop stitch inflatable floor and the drop stitch inflatable sides.

The inflatable dinghy may further include oarlocks glued to each of the drop stitch inflatable sides, respectively.

The transom may be made of wood coated with plastic.

According to yet another aspect, an inflatable skiff includes a drop stitch inflatable floor made of high pressure drop stitch material; port and starboard drop stitch inflatable sides made of high-pressure drop stitch material attached at outside edges of the drop stitch inflatable floor, respectively; a drop stitch inflatable keel attached at a central portion of a bottom of the drop stitch inflatable floor; a rigid bow mold attached to the drop stitch inflatable floor and drop stitch inflatable sides; a rigid stern transom attached to the drop stitch inflatable floor and drop stitch inflatable sides, where the inflatable skiff includes only four separate air compartments including the drop stitch inflatable floor, drop stitch inflatable sides and drop stitch inflatable keel.

In the inflatable skiff, wherein at least one of the drop stitch inflatable floor and drop stitch inflatable keel includes a mast step configured to have a mast stepped therein.

BRIEF DESCRIPTION OF THE DRAWINGS

These and/or other aspects and advantages of the invention will become apparent and more readily appreciated from the following description of the embodiments, taken in conjunction with the accompanying drawings in which.

DESCRIPTION OF EMBODIMENTS

Figure 1:
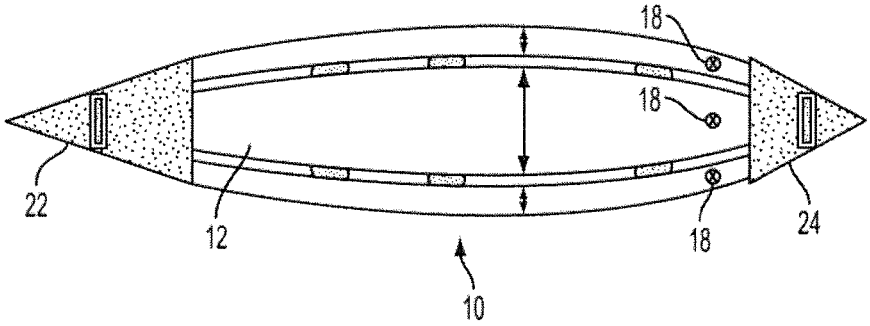
FIG. 1 is top view of an inflatable kayak in accordance with an embodiment.

Reference will now be made in detail to the embodiments of the present invention, examples of which are illustrated in the accompanying drawings, wherein like reference numerals refer to like elements throughout. The embodiments are described below to explain the present invention by referring to the annexed drawings.

Figure 2:
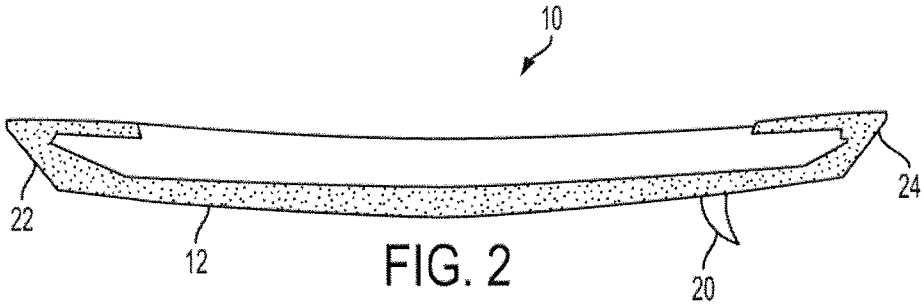
FIG. 2 is a side view of the inflatable kayak in accordance with the embodiment.
Figure 5:
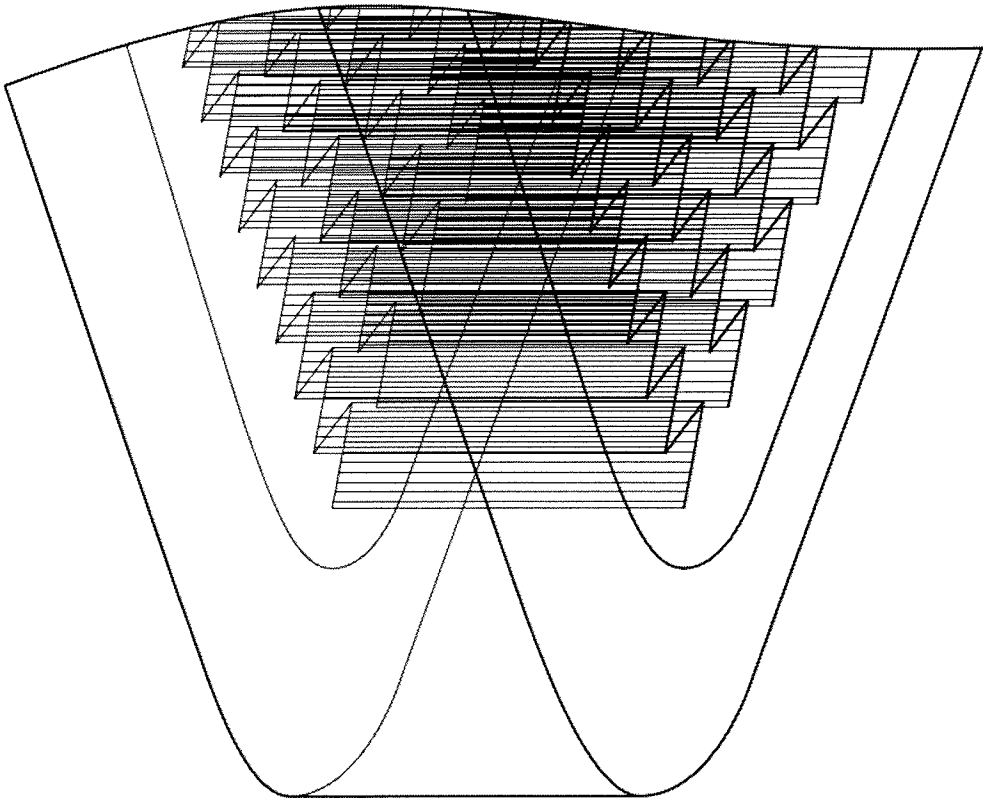
FIG. 5 is a conceptual view of the drop stitch material of the interior of the inflatable kayak in accordance with an embodiment.

As shown in FIGS. 1 and 2, the inflatable kayak 10 includes an inflatable floor 12 made of high-pressure drop stitch material. The inflatable floor 12 may be made of 1000 denier polyester fabric but may be made of other stronger or weaker fabric materials. An example of the drop stitch material is shown in FIG. 5 where thousands of drop stitches are provided to maintain an equal distance between the top and bottom surfaces of the inflatable floor 12. The drop stitch threads may be in a linear, zigzag or random pattern. The drop stitch thread may be configured in linear, or various other patterns including "X" and "V" patterns. The use of drop stitch material in the floor 12 allows the floor 12 to be inflated to a pressure of 15 psi.

Glued or welded directly to the inflatable floor 12 are inflatable sides 14, 16 which are also made of high-pressure drop stitch material formed at port and starboard sides of the inflatable floor 12, respectively. The inflatable sides 14, 16 may also be made of 1000 denier polyester fabric but may be made of other stronger or weaker fabric materials. The drop stitch threads may be in a linear, zigzag or random patterns including "X" and "V" patterns. The use of drop stitch material in the inflatable sides 14, 16 allows the inflatable sides 14, 16 to be inflated to a pressure of 10 psi, 15 psi or greater psi.

Figure 4:
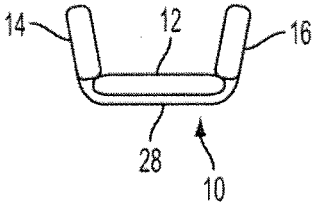
FIG. 4 is a cross-sectional view taken along lines 3-3' of FIG. 2 of the rigid bow of the inflatable kayak in accordance with an embodiment including a non-inflatable floor.

Alternatively, as shown in FIG. 4, the inflatable sides 14, 16 may be glued or welded to a non-inflated fabric floor 28 and the inflatable floor 12 made of high pressure drop stitch material may be positioned and attached to a top of the non-inflated fabric floor 28 with the inflatable sides 14, 16 pressing against the inflatable floor 12 made of high pressure drop stitch material.

Figure 3:
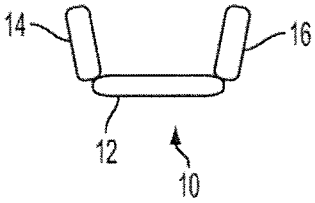
FIG. 3 is a cross-sectional view taken along lines 3-3' of FIG. 2 of the inflatable kayak in accordance with an embodiment.

As shown in FIG. 3, the inflatable sides 14, 16 are configured to be inclined outboard from the inflatable floor 12 to give the inflatable kayak 10 V-shaped sides flaring out from the inflatable floor 12. According to this structure, since the inflatable sides 14, 16 meet the inflatable floor 12 at an angle producing a chine, the speed and ease of paddling the inflatable kayak 10 is increased, particularly in difficult conditions.

The inflatable kayak 10 may have a length of between 9-21 feet, a beam may be between 22-32 inches, and a thickness of the drop stitch material used for the inflatable floor 12 and the inflatable sides 14, 16 may be between 3-8 inches. The inflatable kayak 10 also advantageously may have an asymmetrical shape in a fore and aft direction, being slightly wider aft of an amidships portion and slightly narrower forward of the amidships portion.

However, the shape of the inflatable kayak 10 is not limited to an asymmetrical shape and the inflatable kayak 10 may also be symmetrical in the fore and aft direction.

The inflatable floor 12 and the inflatable sides 14, 16 may each include an air valve 18. The air valves 18 are preferably one-way air valves to prevent blow back during inflation, and to make it easier to close the air valves 18 with a valve cap. The air valves 18 may be locked in an open position for fast deflation prior to transportation and storage.

A skeg 20 is formed on the after portion of the bottom of the inflatable kayak 10. The skeg 20 may be permanently attached or removable for storage or transportation.

At the bow portion of the inflatable kayak 10 is a rigid bow mold 22. Since the drop stitch construction of the inflatable floor 12 and inflatable sides 14, 16 of the inflatable kayak 10 preclude having a sharp bow that is effective to cut waves and increase maneuverability, the inflatable kayak 10 of the present invention includes a rigid bow mold 22 that is attached to the inflatable floor 12 and inflatable sides 14, 16, for example by gluing.

At the stern portion of the inflatable kayak 10 is a rigid stern mold 24. Since the drop stitch construction of the inflatable floor 12 and inflatable sides 14, 16 of the inflatable kayak 10 preclude having a sharp stern that is necessary for reverse paddling in kayaking, the inflatable kayak 10 of the present invention includes a rigid stern mold 24 that is attached to the inflatable floor 12 and inflatable sides 14, 16, for example by gluing.

The rigid bow mold 22 and rigid stern mold 24 of the inflatable kayak 10 may be made of rigid engineering or composite plastic construction or other plastic material, although other non-plastic materials may be used. The lateral sides of the needle nose 30 come together in a point at no more than a 60 degree angle. The rigid bow mold 22 and rigid stern mold 24 gives the inflatable kayak 10 a rigid bow and stern construction that enables a user to cut through waves and to paddle faster, further and easier as compared to conventional inflatable kayaks.

Figure 6:
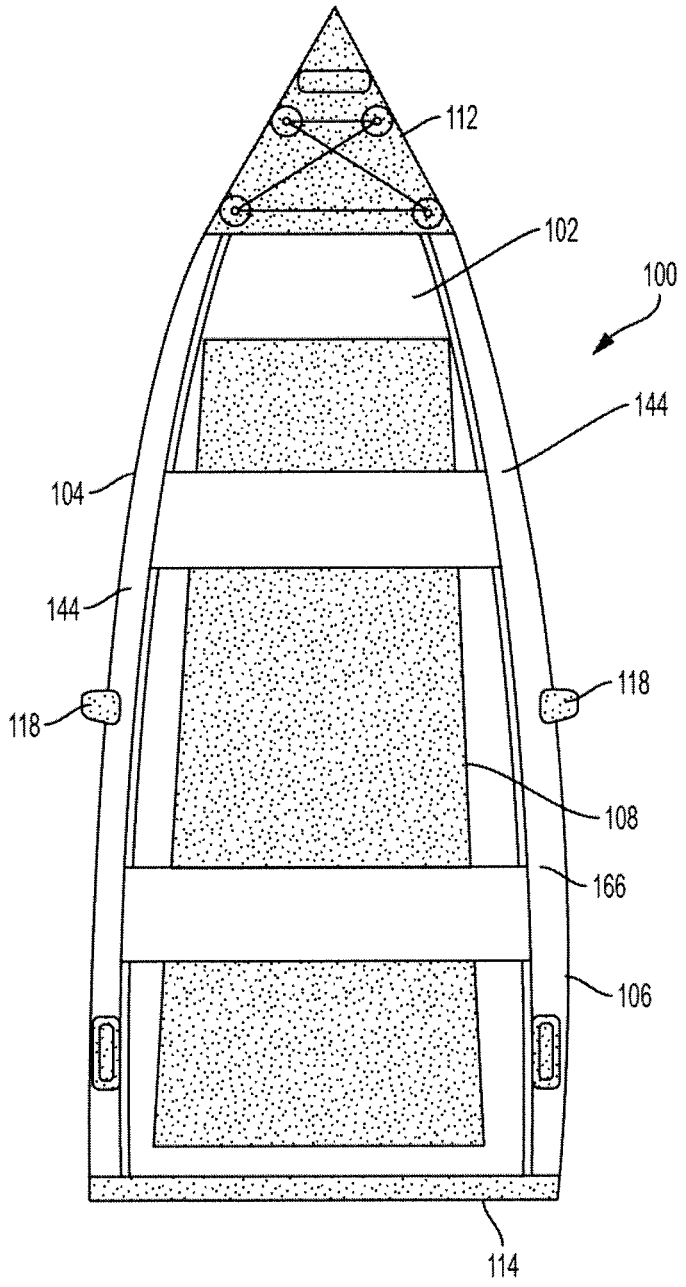
FIG. 6 is top view of an inflatable dinghy in accordance with another embodiment.
Figure 7:
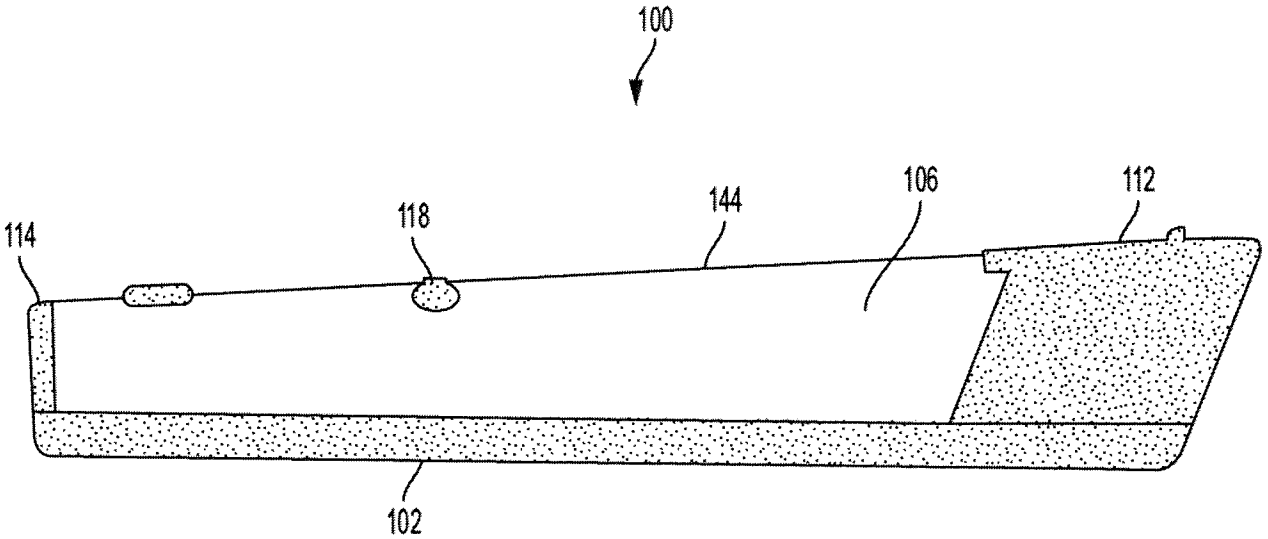
FIG. 7 is a side view of the inflatable dinghy in accordance with the embodiment.

According to another embodiment, as shown in FIGS. 6 and 7, an inflatable dingy 100 includes an inflatable floor 102 made of high-pressure drop stitch material. The inflatable floor 102 may be made of 1000 denier polyester fabric but may be made of other stronger or weaker fabric materials. An example of the drop stitch material is shown in FIG. 5.

Glued or welded directly to the inflatable floor 102 are inflatable sides 104, 106 which are also made of high-pressure drop stitch material formed at port and starboard sides of the inflatable floor 102, respectively. The tops of the drop stitch inflatable sides 104, 106 form gunnels 144, 166 that curve upwards from bow to stern. The inflatable sides 104, 106 may also be made of 1000 denier polyester fabric but may be made of other stronger or weaker fabric materials.

As previously discussed with reference to FIG. 4, the inflatable sides 104, 106 may be glued or welded to a non-inflated fabric floor 108 and the inflatable floor 102 made of high pressure drop stitch material may be positioned and attached to a top of the non-inflated fabric floor 108 with the inflatable sides 104, 106 pressing against the inflatable floor 102 made of high pressure drop stitch material.

The inflatable dinghy 100 may have a length of between 7-12 feet, a beam may be between 40-60 inches, and a thickness of the drop stitch material used for the inflatable floor 12 and the inflatable sides 14, 16 may be between 3-8 inches.

At the bow portion of the inflatable dinghy 100 is a rigid bow mold 112. Since the drop stitch construction of the inflatable floor 102 and inflatable sides 104, 106 of the inflatable dinghy 100 preclude having a sharp bow that is effective to cut waves and increase maneuverability, the inflatable dinghy 100 of the present invention includes a rigid bow mold 112 that is attached to the inflatable floor 102 and inflatable sides 104, 106, for example by gluing.

At the stern portion of the inflatable dinghy 100 is a rigid stern transom 114 which is attached to the inflatable floor 102 and inflatable sides 104, 106, for example by gluing. The rigid stern transom 114 is made of wood coated with plastic, although other suitable materials may be used. The rigid stern transom 114 is adapted to receive an outboard motor.

Oarlocks 118 are disposed at each of the drop stitch inflatable sides 104, 106, respectively.

Figure 8:
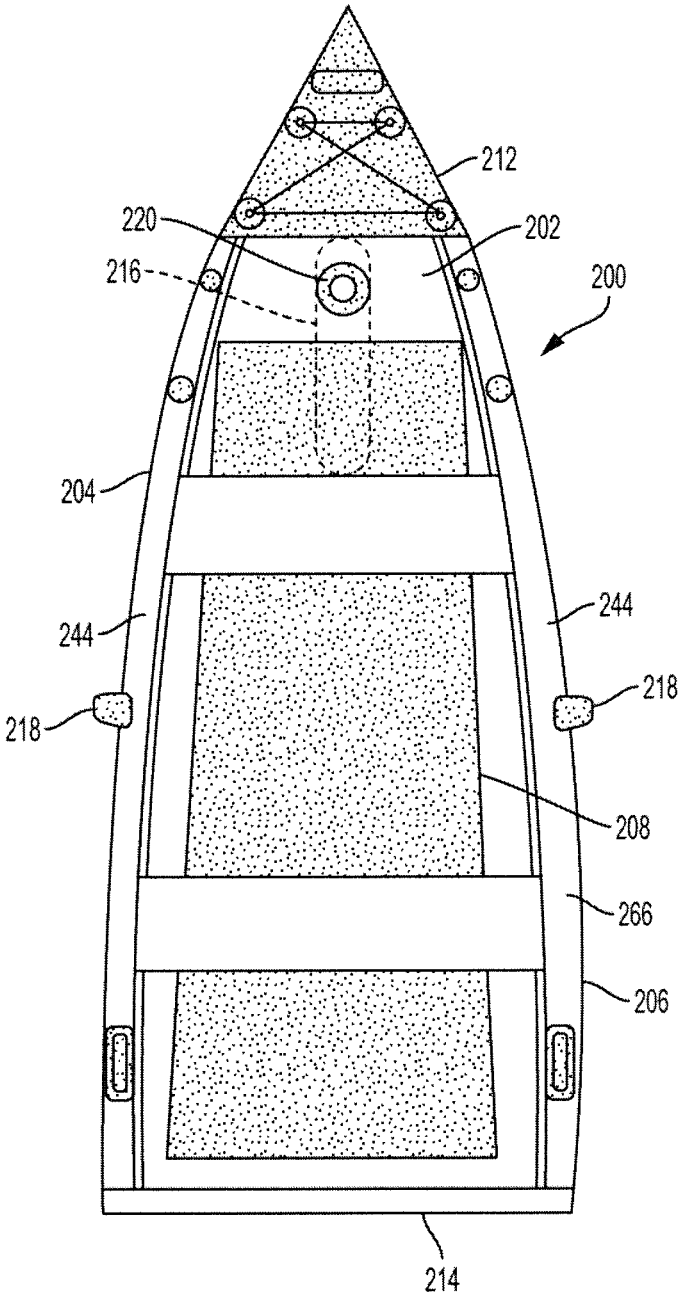
FIG. 8 is top view of an inflatable skiff in accordance with another embodiment.
Figure 9:
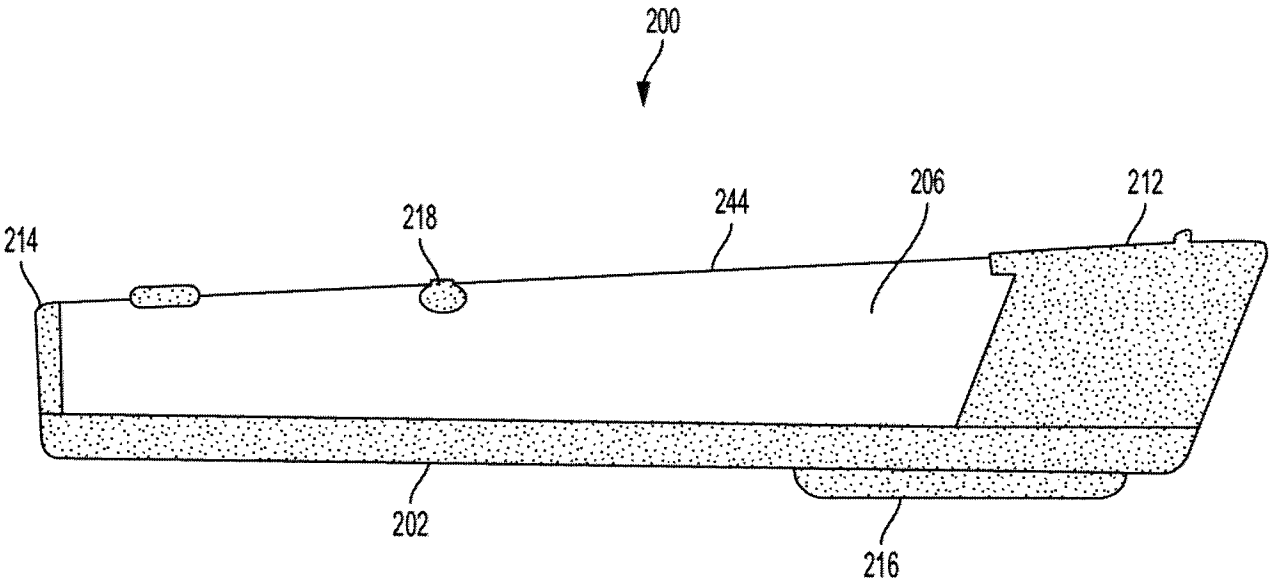
FIG. 9 is a side view of the inflatable skiff in accordance with the embodiment.

According to another embodiment, as shown in FIGS. 8 and 9, an inflatable skiff 200 includes an inflatable floor 202 made of high-pressure drop stitch material. The inflatable floor 202 may be made of 1000 denier polyester fabric but may be made of other stronger or weaker fabric materials. An example of the drop stitch material is shown in FIG. 5.

Glued or welded directly to the inflatable floor 202 are inflatable sides 204, 206 which are also made of high-pressure drop stitch material formed at port and starboard sides of the inflatable floor 202, respectively. The tops of the drop stitch inflatable sides 204, 206 form gunnels 244, 266 that curve upwards from bow to stern. The inflatable sides 204, 206 may also be made of 1000 denier polyester fabric but may be made of other stronger or weaker fabric materials.

A drop stitch inflatable keel 216 having an air foil shape is attached at a central portion of a bottom of the drop stitch inflatable floor 202. At least one of the drop stitch inflatable floor 202 and drop stitch inflatable keel 216 includes a mast step 220 configured to have a mast stepped therein.

As previously discussed with reference to FIG. 4, the inflatable sides 204, 206 may be glued or welded to a non-inflated fabric floor 208 and the inflatable floor 202 made of high pressure drop stitch material may be positioned and attached to a top of the non-inflated fabric floor 208 with the inflatable sides 204, 206 pressing against the inflatable floor 202 made of high pressure drop stitch material.

The inflatable skiff 200 may have a length of between 10-20 feet.

At the bow portion of the inflatable skiff 200 is a rigid bow mold 212. At the stern portion of the inflatable skiff 200 is a rigid stern transom 214 which is attached to the inflatable floor 202 and inflatable sides 204, 206, for example by gluing. The rigid stern transom 214 is made of wood coated with plastic, although other suitable materials may be used. The rigid stern transom 214 is adapted to receive an outboard motor.

Oarlocks 218 are disposed at each of the drop stitch inflatable sides 204, 206, respectively.

Although several embodiments of the invention have been shown and described, it would be appreciated by those skilled in the art that changes may be made in these embodiments without departing from the principles and spirit of the invention, the scope of which is defined in the claims and their equivalents. For example, the present inventive concept may be applied to other types of inflatable watercraft such as a canoe, raft, barge, etc.

What is claimed is:

1. An inflatable dinghy comprising:
- a drop stitch inflatable floor made of high pressure drop stitch material;
- port and starboard drop stitch inflatable sides made of high-pressure drop stitch material attached at outside edges of the drop stitch inflatable floor, respectively;
- a rigid bow mold attached to the drop stitch inflatable floor and drop stitch inflatable sides; and
- a rigid stern transom attached to the drop stitch inflatable floor and drop stitch inflatable sides,
- wherein the inflatable dinghy includes only three separate air compartments consisting of the drop stitch inflatable floor and the drop stitch inflatable sides.

2. The inflatable dinghy of claim 1, wherein the drop stitch inflatable sides are glued or welded directly to outside edges of the drop stitch inflatable floor,
- wherein the drop stitch inflatable sides are configured to be flared outboard from the drop stitch inflatable floor, and
- wherein the tops of the drop stitch inflatable sides form gunnels that curve upwards from bow to stern.

3. The inflatable dinghy of claim 1, further comprising a non-inflated fabric floor,
- wherein the drop stitch inflatable floor is positioned and attached to a top of the non-inflated fabric floor so that the drop stitch inflatable sides press against the drop stitch inflatable floor, and
- wherein the drop stitch inflatable sides are glued or welded directly to outside edges of the non-inflated fabric floor.

4. The inflatable dinghy of claim 1, wherein the high pressure drop stitch material of the drop stitch inflatable floor and drop stitch inflatable sides comprises a polyester fabric of approximately 1000 denier.

5. The inflatable dinghy of claim 1, wherein the drop stitch inflatable floor and drop stitch inflatable sides are configured to be inflated to at least 15 psi.

6. The inflatable dinghy of claim 1, wherein the inflatable dinghy has a length of between 7-12 feet.

7. The inflatable dinghy of claim 1, wherein the inflatable dinghy has a beam of between 40-60 inches.

8. The inflatable dinghy of claim 1, wherein a thickness of the drop stitch material used for the drop stitch inflatable floor and the inflatable sides is between 3-8 inches.

9. The inflatable dinghy of claim 1, further comprising oarlocks glued to each of the drop stitch inflatable sides, respectively.

10. The inflatable dinghy of claim 1, wherein the transom is made of wood coated with plastic.

11. An inflatable skiff comprising:
- a drop stitch inflatable floor made of high pressure drop stitch material;

port and starboard drop stitch inflatable sides made of high-pressure drop stitch material attached at outside edges of the drop stitch inflatable floor, respectively;

a drop stitch inflatable keel attached at a central portion of a bottom of the drop stitch inflatable floor;

a rigid bow mold attached to the drop stitch inflatable floor and drop stitch inflatable sides; and a rigid stern transom attached to the drop stitch inflatable floor and drop stitch inflatable sides, wherein the inflatable skiff includes only four separate air compartments consisting of the drop stitch inflatable floor, drop stitch inflatable sides and drop stitch inflatable keel.

12. The inflatable skiff of claim 11, wherein the drop stitch inflatable sides are glued or welded directly to outside edges of the drop stitch inflatable floor, wherein the drop stitch inflatable sides are configured to be flared outboard from the drop stitch inflatable floor, and wherein the tops of the drop stitch inflatable sides form gunnels that curve upwards from bow to stern.

13. The inflatable skiff of claim 11, further comprising a non-inflated fabric floor, wherein the drop stitch inflatable floor is positioned and attached to a top of the non-inflated fabric floor so that the drop stitch inflatable sides press against the drop stitch inflatable floor, and the drop stitch inflatable sides are glued or welded directly to outside edges of the non-inflated fabric floor.

14. The inflatable skiff of claim 11, wherein the high pressure drop stitch material of the drop stitch inflatable floor, drop stitch inflatable sides and drop stitch inflatable keel comprises a polyester fabric of approximately 1000 denier.

15. The inflatable skiff of claim 11, wherein the drop stitch inflatable floor, drop stitch inflatable sides and drop stitch inflatable keel are configured to be inflated to at least 15 psi.

16. The inflatable skiff of claim 11, wherein the inflatable skiff has a length of between 10-20 feet.

17. The inflatable skiff of claim 11, wherein at least one of the drop stitch inflatable floor and drop stitch inflatable keel includes a mast step configured to have a mast stepped therein.

18. The inflatable skiff of claim 11, further comprising oarlocks glued to each of the drop stitch inflatable sides, respectively.

19. The inflatable skiff of claim 11, wherein the transom is made of wood coated with plastic.

* * * * *